US008718503B2

(12) United States Patent
Kanazawa et al.

(10) Patent No.: US 8,718,503 B2
(45) Date of Patent: May 6, 2014

(54) IMAGE FORMING APPARATUS

(75) Inventors: Takayuki Kanazawa, Suntou-gun (JP); Kentarou Kawata, Numazu (JP); Takuya Kitamura, Numazu (JP); Yuji Kawaguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 327 days.

(21) Appl. No.: 12/969,092

(22) Filed: Dec. 15, 2010

(65) Prior Publication Data

US 2011/0150519 A1 Jun. 23, 2011

(30) Foreign Application Priority Data

Dec. 21, 2009 (JP) ..... 2009-288821
Nov. 5, 2010 (JP) ..... 2010-248982

(51) Int. Cl.
*G03G 15/00* (2006.01)

(52) U.S. Cl.
USPC ..... 399/71

(58) Field of Classification Search
USPC ..... 399/71
See application file for complete search history.

(56) References Cited

U.S. PATENT DOCUMENTS 3,843,407 A * 10/1974 Thorp ..... 134/6
5,376,990 A * 12/1994 Savage ..... 399/26
6,539,189 B2 3/2003 Yanagida
2007/0134019 A1 * 6/2007 Ando et al. ..... 399/100

FOREIGN PATENT DOCUMENTS

JP 2001-305770 A 11/2001

* cited by examiner

*Primary Examiner* — Walter L Lindsay, Jr.
*Assistant Examiner* — Barnabas Fekete
(74) *Attorney, Agent, or Firm* — Canon USA, Inc., IP Division

(57) ABSTRACT

An image forming apparatus includes a control unit that performs two types of stop operations in which an image bearing member is rotated or is not rotated after forming an image. The control unit selects the stop operation according to operation time of the image bearing member.

10 Claims, 12 Drawing Sheets

PERFORMING IMAGE FORMING PROCESS (POSITIVE ROTATION)

STOP FROM POSITIVE ROTATION

INVERSELY ROTATING

STOP AFTER INVERSE ROTATION

IMAGE FORMING APPARATUS

BACKGROUND OF THE INVENTION

1. Field of the Invention

The present invention relates to an image forming apparatus that employs an electrophotographic recording method, such as a laser printer, a copying machine, or a facsimile. In particular, the present invention relates to an image forming apparatus that causes a cleaning member, e.g., an elastic cleaning blade, to come into contact with and remove a developer from a latent image bearing member, e.g., an electrophotographic photosensitive member. Further, the present invention relates to a control method for driving the image bearing member.

2. Description of the Related Art

An electrophotographic image forming apparatus transfers a developer image (i.e., a toner image) formed on a surface of an image bearing member to a transfer material, i.e., a recording medium. Examples of the image bearing member are a photosensitive member, i.e., a latent image bearing member, and an intermediate transfer member. A cleaning device then removes residual toner remaining on the image bearing member after the developer image has been transferred to the transfer material.

In general, a blade cleaning method is employed as the cleaning device. In such a method, a flexible (having rubber elasticity) cleaning blade, i.e., a cleaning member, is caused to come into contact with the image bearing member at a predetermined pressing state. The cleaning blade thus cleans the image bearing member by scraping and removing the toner remaining on the image bearing member after the image is transferred. Further, the cleaning blade is generally caused to come into contact with the image bearing member counter to a rotation direction of the image bearing member when forming an image.

The cleaning blade in the above-described image forming apparatus employing the blade cleaning method may become turned over by friction generated between the cleaning blade and the image bearing member. There are techniques for performing low friction processing on a surface of the image bearing member or the blade to prevent such a blade turn over. For example, Japanese Patent Application Laid-Open No. 2001-305770 discusses applying a lubricant on the surface of the image bearing member to decrease a friction coefficient, so that the blade turn over can be reduced.

On the other hand, when the above-described image forming apparatus employing the blade cleaning method continues printing using sheets that generate a large amount of paper dust, the paper dust may become stuck between the cleaning blade and the image bearing member (e.g., photosensitive drum, hereinafter referred to as drum). If the image forming apparatus continues to print while the paper dust continues to be stuck, the drum may become scratched and may generate image deterioration by forming vertical streaks in the image. The amount of the paper dust becoming stuck can be reduced by performing the above-described low friction processing on the surface of the image bearing member or the blade. Since a frictional force between the image bearing member and the blade becomes small by performing low friction processing on the image bearing member, the paper dust becomes less firmly stuck. Another method for reducing the stuck paper dust is to rotate the image bearing member in an opposite direction after printing to release the stuck paper dust. U.S. Pat. No. 6,539,189 discusses such a method of reducing the stuck paper dust.

However, when low friction processing is performed on the image bearing member or the cleaning blade in the above-described image forming apparatus employing the blade cleaning method, two different types of image deterioration may be generated. The type of the image deterioration which is generated depends on a usage state of the image bearing member or the blade. Such image deterioration will be described in detail below.

Much of the lubricant applied on the surface of the blade or the image bearing member in the cleaning device becomes separated along with the rotation of the image bearing member in an initial usage state of the blade or the image bearing member. The separated lubricant often becomes collected at a leading edge of the blade along with the rotation of the image bearing member. The leading edge of the blade on which the lubricant is collected is then pressed against the image bearing member by a predetermined amount of pressing force or greater. As a result, the lubricant becomes marked on the image bearing member, so that the image forming apparatus outputs a deteriorated image having the horizontal streak.

Further, the amount of paper dust stuck between the blade and the image bearing member increases after the initial usage state of the blade or the image bearing member, even when the lubricant is applied on the surface of the blade or the image bearing member. The paper dust thus scratches the drum, and image deterioration due to vertical streaks may be generated.

SUMMARY OF THE INVENTION

The present invention is directed to reducing, when an image bearing member or a cleaning blade on which low friction processing has been performed using a lubricant is employed, image deterioration caused by lubricant adhesion or scratching of the image bearing member, and maintaining high image quality, by using the image forming apparatus.

An image forming apparatus includes: an image bearing member having a layer including a lubricant on a surface, which carries an electrostatic latent image; a developing device configured to develop an electrostatic latent image on the image bearing member as a developer image; a cleaning device that presses a cleaning blade on the image bearing member via a lubricant and removes a developer on the image bearing member when the image bearing member rotates; a detecting unit configured to detect information about an operation time of the image bearing member; and a control unit. The image bearing member is rotated in a first direction to form an image. The control unit performs, when the image is formed, a first stop operation control in which the image bearing member is stopped without rotating the image bearing member in a second direction which is in an opposite direction of the first direction, and a second stop operation control in which the image bearing member is rotated in the second direction and stopped. The cleaning blade is disposed in a counter direction with respect to the first direction. The control unit performs, when an operation time of the image bearing member acquired from information about the operation time detected by the detection unit is defined as a first operation time and an operation time of the image bearing member which is longer than the first operation time is defined as a second operation time, the first stop operation control in a case of the first operation time, and the second stop operation control in a case of the second operation time.

According to the present invention, image deterioration caused by lubricant adhesion or scratching of the image bearing member is reduced by using the image forming apparatus, so that high image quality can be maintained.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The first exemplary embodiment of the present invention will be described below with reference to FIG. 2.

Size, material, shape, and relative positions of components described in the present exemplary embodiment may be changed as appropriate according to a configuration of the apparatus to which the invention is to be applied and various conditions. The present invention is thus not limited to the exemplary embodiments to be described below. Further, a monochrome printer is described as an example of the simplest image forming apparatus according to the present exemplary embodiment. However, the present invention may also be realized by tandem type and rotary color laser printers.

Figure 2:
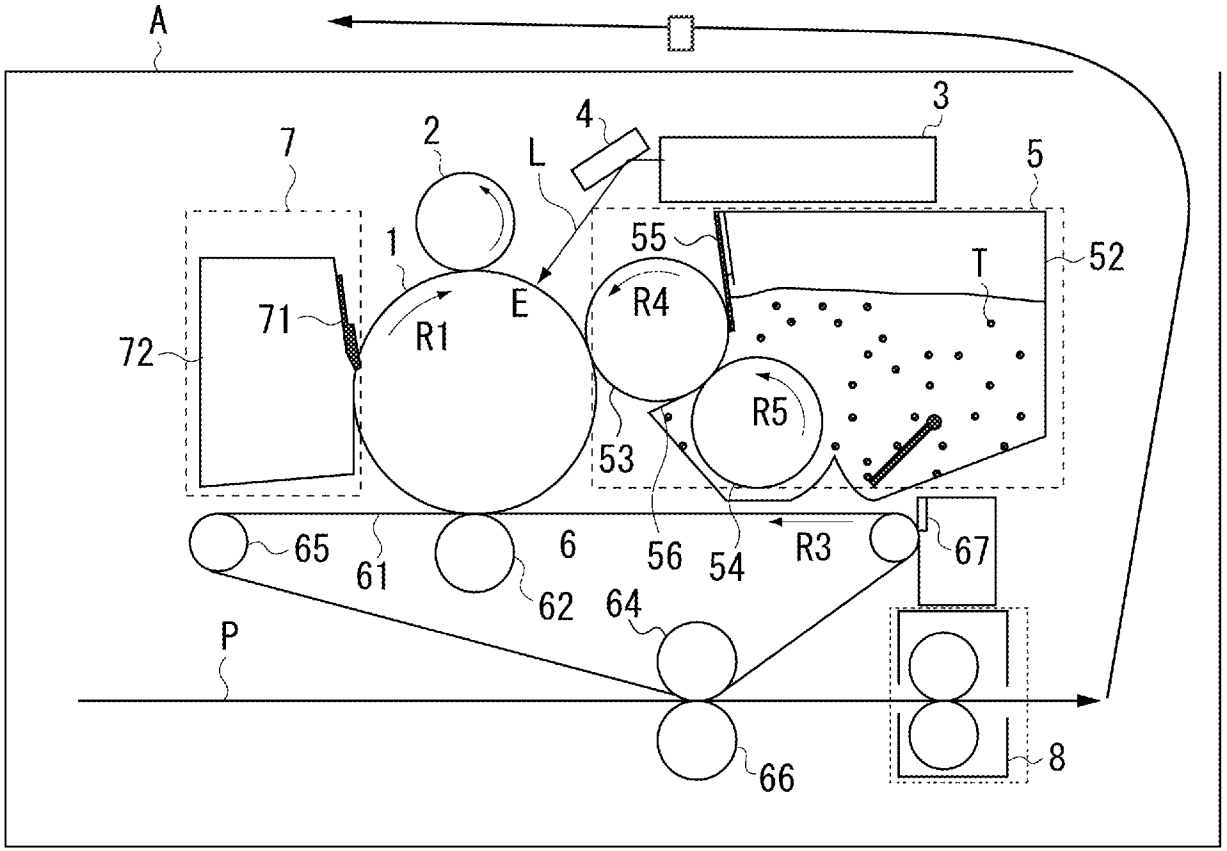
FIG. 2 is a schematic cross-sectional view illustrating an image forming apparatus according to the present invention.

FIG. 2 is a schematic diagram illustrating an image forming apparatus according to the present invention. Referring to FIG. 2, an image forming apparatus A is an electrophotographic image forming apparatus. A host apparatus (not illustrated) such as an image reader (i.e., a document image reading apparatus), a personal computer, or a facsimile, inputs an electric image signal to a controller unit (i.e., a control unit or a central processing unit (CPU)) in the image forming apparatus A. The image forming apparatus A then forms an image on a sheet type recording material P. i.e., a recording medium, based on the electric image signal. The controller unit receives various types of electrical information from the host apparatus and an operation unit of the image forming apparatus. The controller unit also collectively controls the image forming process performed by the image forming apparatus A according to a predetermined control program or a reference table. The operation unit includes a main power source switch (not illustrated).

The image forming apparatus A according to the present exemplary embodiment includes a photosensitive drum (hereinafter referred to as a drum) 1, i.e., an image bearing member, that carries a latent electrostatic image on the surface. The image forming apparatus A further includes a charging unit 2, an exposure unit 3, a developing unit 5, a transfer unit 6, and a drum cleaning unit 7, as a process unit. The drum 1 is rotatably-driven around a drum shaft line at a predetermined speed in a clockwise direction indicated by an arrow R1 illustrated in FIG. 2. According to the present exemplary embodiment, the drum 1, the charging unit 2, the developing unit 5, and the drum cleaning unit 7 are integrated as a cartridge 9 that is detachably attached to the image forming apparatus main body. The cartridge 9 includes a non-volatile memory 10 (illustrated in FIG. 7) that is a storing unit for storing an operating time of the drum 1 from when the cartridge 9 is placed in a new state.

The charging unit 2 uniformly charges the surface of the drum 1 to a predetermined polarity (a negative polarity according to the present exemplary embodiment) and potential. The charging unit 2 includes a charging roller 2, a supporting member (not illustrated), and a spring member (not illustrated) as main portions. The supporting member which is conductive supports the charging roller 2 at both ends to be freely rotatable. The spring member presses the charging roller 2 against the drum 1 via the supporting member. A charging bias power source (not illustrated) disposed in the image forming apparatus main body applies a voltage to the charging roller 2 via the spring member and the supporting member.

The exposure unit 3 forms the electrostatic latent image on the surface of the drum 1. According to the present exemplary embodiment, a laser scanner unit is used as the exposure unit 3. The exposure unit 3 outputs a laser beam L that is modulated according to image information input from the host apparatus (not illustrated) to the controller unit (not illustrated). The exposure unit 3 then scan-exposes via a reflecting mirror 4 the charged surface of the drum 1 with the laser beam L at an exposing region E. As a result, the electrostatic latent image is formed on the surface of the drum 1. According to the present exemplary embodiment, an image exposure method for exposing the charged drum surface according to the image information is employed in forming the electrostatic latent image.

The developing unit 5 visualizes the electrostatic latent image formed on the surface of the drum 1 as the developer image (toner image). The developing unit 5 includes a developing roller 53, i.e., a developer bearing member, configured to be in contact with the drum 1. According to the present exemplary embodiment, the developing unit 5 is a contact developing type inverse developing unit using non-magnetic toner of a negative polarity as developer T. More specifically, the developing unit 5 according to the present exemplary embodiment contains black toner. The developing unit 5 includes a developer container 52, the developing roller 53, an applying roller 54, a regulating blade 55, and a leak prevention seal 56. The container 52 is a chamber containing the toner T as a developer. The developing roller 53 is the developer bearing member that develops the electrostatic latent image formed on the drum 1. The applying roller 54 is a developer supplying member that comes into contact with and supplies the toner to the developing roller 53. The regulating blade 55 is a developer layer thickness regulating member that regulates a toner layer on the developing roller 53. The leak prevention seal 56 prevents the toner from leaking from a gap between the developing roller 53 and the developer container 52.

The transfer unit 6 transfers the toner image formed on the surface of the drum 1 to the recording medium. According to the present exemplary embodiment, an intermediate transfer belt unit is employed as the transfer unit 6. The transfer unit 6 includes an endless intermediate transfer belt (hereinafter referred to as a belt) 61 as an intermediate transfer member (i.e., a first recording medium). The belt 61 is a dielectric elastic member formed of polyethylene naphthalate. The transfer unit 6 further includes a primary transfer roller 62, a belt driving roller (not illustrated), an opposing secondary transfer roller 64, and a tension roller 65, around which the belt 61 is entrained. The primary transfer roller 62 and the opposing secondary transfer roller 64 are formed of an ethylene propylene diene monomer (EPDM) sponge. The primary transfer roller 62 presses against the drum 1 by sandwiching the belt 61 with the drum 1. The contacting portion between the drum 1 and the belt 61 forms a primary transfer nip portion.

A secondary transfer roller 66 is disposed opposite to a belt suspending portion of the secondary transfer opposing roller 64. An oscillating mechanism (not illustrated) moves the secondary transfer roller 66 between an applying position and a non-applying position. More specifically, the secondary transfer roller 66 comes into contact with the opposing secondary transfer roller 64 by sandwiching the belt 61 at the applying position, and retracts from the surface of the belt 61 at the non-applying position. The secondary transfer roller 66 moves from the non-applying position to the applying position at timing that the toner image is transferred from the belt 61 to a recording material such as paper. When the secondary transfer roller 66 is moved to the applying position, the contacting portion between the secondary transfer roller 66 and the belt 61 forms a secondary transfer nip portion.

A belt cleaning unit 67 which cleans the surface of the belt 61 is disposed at the belt suspending portion of the tension roller 65. The belt cleaning unit 67 is constantly in contact with the surface of the belt 61 and cleans and collects the residual toner that has not been transferred (i.e., transfer residual toner) from the belt.

The drum cleaning unit 7 removes the remaining toner from the drum 1 after the toner image is primary transferred to the belt 61. The drum cleaning unit 7 employs a cleaning blade 71 formed of polyurethane rubber. The toner removed from the surface of the drum 1 is collected in a cleaner container 72. A free end of the cleaning blade 71 is disposed upstream in a rotational direction of the drum 1 when forming an image, with respect to the fixed end of the cleaning blade 71. In other words, the cleaning blade 71 is disposed in a counter direction, so that the toner can be efficiently removed.

Figure 3:
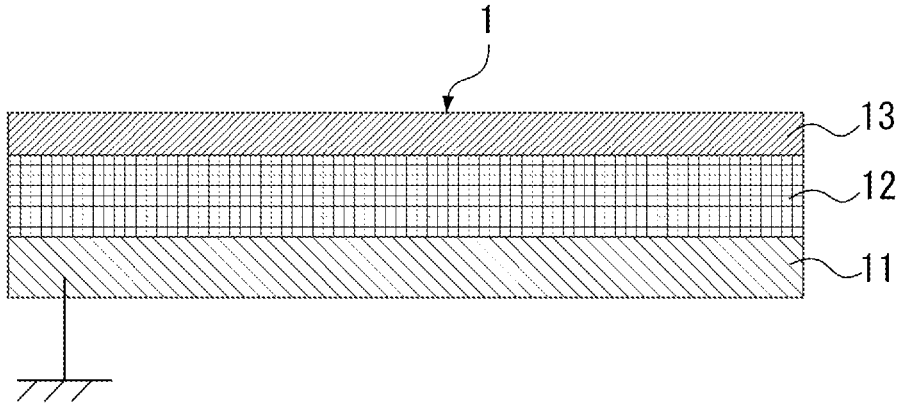
FIG. 3 is a schematic diagram illustrating a photosensitive drum.

The drum 1, i.e., the electrostatic latent image bearing member according to the present exemplary embodiment, will be described below. FIG. 3 is a schematic diagram illustrating a layer configuration of the drum 1. Referring to FIG. 3, an electrophotographic photosensitive layer (i.e., a charge generation layer) 12 is formed on a conductive supporting member 11. A surface layer (i.e., a charge transfer layer) 13 is formed on the photosensitive layer 12. The surface layer is mainly formed by coating and drying a charge transfer material, binder resin, and a lubricant solved into a solvent. Since a surface energy of the lubricant is smaller than those of the charge transfer material and the binder resin, the lubricant precipitates on the surface layer 13 in the drying process. Various triarylamine compounds, hydrazone compounds, and stilbene compounds are used as the charge transfer material.

According to the present exemplary embodiment, the drum 1 has a layer that includes the lubricant on the surface. The lubricant on the surface is gradually separated while the drum 1 repeatedly rubs against the cleaning unit 7 in the printing process. The lubricant is included in the layer to reduce in an unused photosensitive member unit, a friction coefficient μbetween the surface of the drum 1 and the cleaning blade 71 until a lubricant material such as the transfer residual toner initially reaches the cleaning blade 71. The reduction of the friction coefficient μprevents the cleaning blade 71 from becoming tacked and turned over. More specifically, when adherence of the cleaning blade 71 to the surface of the drum 1 increases, the cleaning blade 71 is pulled by the rotation of the drum 1 and becomes turned over. The cleaning blade 71 becomes tacked when the cleaning blade 71 firmly adheres onto the drum 1. Frictional resistance between the surface of the drum 1 and the cleaning blade 71 can thus be reduced without applying the lubricant on the cleaning blade 71 by including the lubricant layer on the surface of the drum 1. By performing the printing process, the toner is supplied to the photosensitive drum 1 and also to the cleaning blade 71. The toner functions as a lubricant material, so that the friction coefficient μbetween the surface of the drum 1 and the cleaning blade 71 remains small even after the lubricant becomes separated from the surface of the drum 1.

According to the present exemplary embodiment, a comb-shaped polymer is used as the lubricant. Lubricants such as US270, US380, and US450 are on market (manufactured by Toa Gouseisha, Inc.), and US270 is used in the present exemplary embodiment. However, the lubricants are not limited to the above-described ones, and the phenomenon described in the present exemplary embodiment can be generated using lubricants in general, such as dimethyl silicon oil and methylphenyl silicon oil.

Further, according to the present exemplary embodiment, the surface layer is formed by coating and drying the coating material formed by solving the charge transfer material, the binder resin, and the lubricant in a solvent. However, the surface layer is not limited to the above-described one. A surface layer including a lubricant can be formed by coating and drying only the lubricant on the surface of the drum 1 after forming the charge transfer layer.

Furthermore, according to the present exemplary embodiment, the lubricant is applied on the drum 1. The case where the lubricant is applied on the cleaning blade will be described below. In such a case, the lubricant applied on the cleaning blade also becomes gradually separated when the drum 1 and the cleaning blade rub against each other in the image forming process. According to the present exemplary embodiment, the drum rotates while the cleaning blade is in contact with the drum, so that the operating time of the cleaning blade is the same as that of the drum. A similar control can thus be performed by using the operating time of the drum. If the cleaning blade can select between a contact state and a separated state from the drum, it becomes necessary to separately detect the operation time of the cleaning blade.

The image forming process performed by the image forming apparatus A will be described below. Upon input of a signal to start the image forming process, the controller unit (not illustrated) drives a main motor (not illustrated). The drum 1 is then driven in a direction indicated by the arrow R1 illustrated in FIG. 2, and the belt 61 is driven in a direction indicated by an arrow R3 illustrated in FIG. 2 at a process speed of 150 mm/sec. The charging roller 2, i.e., a charging unit, is rotatably driven along with driving of the drum 1, and a direct voltage of approximately −1000 V is applied as a charging bias. The charging roller 2 thus charges a surface potential of the drum 1 to a dark potential (VD) of −500 V.

The developing roller 53 in the developing unit 5 is in contact with the drum 1, so that the drive of the drum 1 is transmitted to the developing roller 53. A direct voltage of −300 V is then applied as a developing bias. The secondary transfer roller 66 is moved to and maintained in the non-applying position separated from the belt 61.

The exposure unit 3 outputs and scan-exposes the surface of the drum 1 with the laser beam L that is modulated according to the image signal. The electrostatic latent image corresponding to the image is thus formed on the surface of the drum 1. The potential of the exposed region becomes a light potential (VL) of −100 V. The developing unit 5 then develops the electrostatic latent image into the toner image (developer image).

According to the present exemplary embodiment, the developing roller 53 of the developing unit 5 is in contact with the drum 1 via the toner. The developing roller 53 thus develops the electrostatic latent image formed on the drum 1 while being in contact with the drum 1. In other words, the present exemplary embodiment employs a contact developing method. When forming the image, a driving unit (not illustrated) and a power source (not illustrated) in the image forming apparatus main body input a driving force and the developing bias to the developing unit 5. The developing roller 53 is then rotatably driven in a direction indicated by an arrow R4 illustrated in FIG. 2 at a predetermined speed. The rotational direction of the developing roller 53 at the drum contacting portion is thus in the same direction as the rotational direction of the drum 1. A rotational driving speed of the developing roller 53 is 225 mm/sec, so that a number of rotations of the developing roller 53 is 1.5 times the number of rotations of the drum 1.

The applying roller 54 which is in contact with and supplies the toner to the developing roller 53 is rotatably driven in a direction indicated by an arrow R5 illustrated in FIG. 2 at a predetermined speed. As a result, the rotational direction of the applying roller 54 at the developing roller contact portion is the opposite direction (counter direction) of the rotational direction R4 of the developing roller 53. The applying roller 54 rotates and applies the toner on the peripheral surface of the rotating developing roller 53. The regulating blade 55 then coats the roller with the applied toner to be a thin layer.

The developing roller 53 continues to rotate, so that the thin toner layer is conveyed and applied to the surface of the drum 1. Further, a developing bias power source V applies the direct current of −300 V to the developing roller 53. The thin toner layer on the peripheral surface of the developing roller 53 is thus selectively transferred to the surface of the drum 1 according to the electrostatic latent image on the surface of the drum 1. The developing roller 53 continues to rotate to convey and return to the developer container 52 the toner that is not used in developing the electrostatic latent image. The applying roller 54 removes the remaining toner from the surface of the developing roller 53 and again applies the toner on the developing roller 53. Such an operation is repeated, so that the electrostatic latent image on the surface of the drum 1 becomes developed.

The toner image developed on the drum 1 is primary transferred to the belt 61 at the primary transfer nip portion. A primary transfer bias of a charging polarity that is opposite to the charging polarity of the toner (i.e., a positive polarity) is applied to the primary transfer roller 62 at predetermined control timing. The voltage applied to the primary transfer roller 62 in the primary transfer is controlled to be of a constant voltage when the image is being formed.

The cleaning blade 71 removes the transfer residual toner remaining on the drum 1 after the primary transfer. The removed toner is collected and contained in the cleaner container 72. The cleaning blade 71 is generally formed of a flexible material such as urethane rubber, and it is necessary to optimize conditions such as rubber hardness, thickness, elasticity, and a projecting amount. The charging unit 2 then charges the drum 1 to prepare for the next image forming process.

A recording material feeding unit separates and feeds one sheet of a recording material P, i.e., a second recording medium of a sheet form, at predetermined control timing. A registration roller unit (not illustrated) conveys the recording material P at predetermined control timing to the secondary transfer nip portion, i.e., the contact portion between the secondary transfer roller 66 and the belt 61. To the secondary transfer roller 66 is then applied a secondary transfer bias of a predetermined potential having an opposite polarity (positive polarity) from the toner charging polarity. The voltage applied to the secondary transfer roller 66 is controlled to be of a constant voltage when the image is being formed. The toner image on the belt 61 is thus sequentially and collectively secondary-transferred to the recording material P while the recording material P is held between and conveyed through the secondary transfer nip portion.

The recording material P is then separated from the surface of the belt 61 and guided to a fixing unit 8, and heated and pressed at a fixing nip portion. The toner image is thus fixed to the recording material P. The recording material P is output from the fixing unit 8 and is discharged to a discharging portion (not illustrated) as a printed product. Further, the belt cleaning unit 67 removes the secondary transfer residual toner remaining on the surface of the belt 61 after the recording material is separated from the belt 61.

Upon completion of the image forming process, the controller unit (not illustrated) stops driving the drum 1, the exposure unit 3, and the belt 61, and moves the secondary transfer roller 66 to the non-applying position. The controller unit then shifts to a waiting state and waits for the image forming start signal to be input. The image forming process ends after the image is formed on the recording material based on the image forming signal transmitted from the host apparatus. If the host apparatus transmits continuous image forming signals to form images on a plurality of recording materials, the image forming process ends after the images are formed on the plurality of sheets.

The method for stopping the rotation of the drum 1 that has been rotated in the image forming process will be described in detail below with reference to experimental results. A first direction in which the drum 1 is rotated in the image forming process will be defined as positive rotation, and a second direction opposite to the direction of the positive rotation will be defined as inverse rotation.

Problems of the paper dust becoming stuck between the cleaning blade and the drum, and the lubricant adhesion to the drum, will be described below. The printing operation described below is performed at a normal temperature of 23° C.

The paper dust becomes stuck between the cleaning blade 71 and the drum 1 as follows. When the toner image is transferred at the secondary transfer nip portion to the paper, i.e., the recording material, the paper dust from the paper adheres to the belt 61. The paper dust adhering to the belt 61 reaches the primary transfer nip portion by the rotation of the belt 61, and is then transferred from the belt 61 to the drum 1. The paper dust then reaches the contact portion between the cleaning blade 71 and the drum 1 by the rotation of the drum 1. If the drum 1 rotates while the paper dust is stuck between the cleaning blade 71 and the drum 1, the drum 1 becomes scratched, which affects the image to be formed. According to the present exemplary embodiment, the toner image is transferred to the recording material via the belt 61, i.e., the intermediate transfer member. However, a similar problem occurs in an apparatus in which the toner image is directly transferred from the drum 1 to the recording material.

The lubricant adheres to the drum 1 as a result of the lubricant becoming collected at the tip of the cleaning blade 71. When the tip of the cleaning blade 71 on which the collected lubricant adheres is pressed onto the drum 1, the lubricant adheres to the drum 1. As a result, a deteriorated image in which horizontal streaks are generated may be output. A specific phenomenon which occurs will be described below.

Levels of the phenomena occurring when the drum is stopped in positive rotation and after inverse rotation in the cases where the paper dust becomes stuck and the lubricant adheres will be indicated below. Mechanisms of such phenomena will then be described.

TABLE 1A

| Levels of paper dust becoming stuck | | | | | |
|---|---|---|---|---|---|
| | Drum rotation time | | | | |
| | 1 min. | 3 min. | 5 min. | 10 min. | 15 min. |
| Drum stopped in positive rotation | Y | Y | Y | N | N |
| Drum stopped after inverse rotation | Y | Y | Y | Y | Y |

Y: Paper dust becomes stuck
N: Paper dust does not become stuck

TABLE 1B

| Levels of lubricant adhesion | | | | | |
|---|---|---|---|---|---|
| | Drum rotation time | | | | |
| | 1 min. | 3 min. | 5 min. | 10 min. | 15 min. |
| Drum stopped in positive rotation | Y | Y | Y | Y | Y |
| Drum stopped after inverse rotation | N | N | N | Y | Y |

Figure 4:
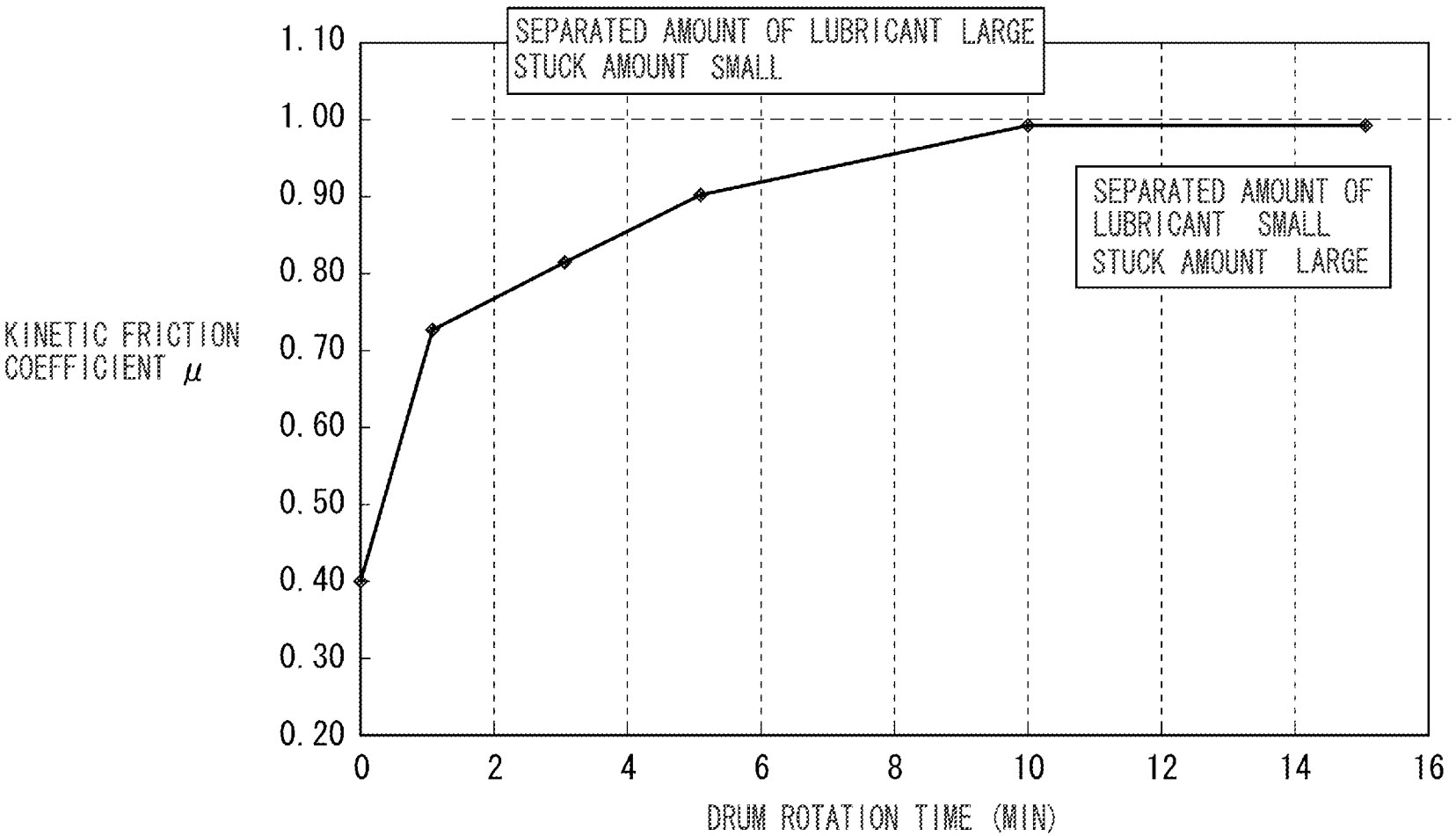
FIG. 4 illustrates a change in a kinetic friction coefficient between the drum and the cleaning blade with respect to a rotation time of the drum.

Y: Within acceptable limit of adhesion mark generation
N: Exceed acceptable limit of adhesion mark generation Table 1A indicates levels of the paper dust becoming stuck. The drum rotation time is the rotation time of the drum from when the drum is initially used. The level of the paper dust becoming stuck is lower when the rotation time of the drum is short. FIG. 4 is a graph illustrating a kinetic friction coefficient between the drum and the cleaning blade with respect to the rotation time of the drum. Referring to FIG. 4, the kinetic friction coefficient between the drum and the cleaning blade increases as the drum is rotated, so that it becomes easier for the paper dust to become stuck as the drum rotation time becomes longer. Since the lubricant is gradually separated as the drum is rotated, the kinetic friction coefficient increases. On the other hand, since the toner functions as the lubricant, the kinetic friction coefficient is stabilized at a certain level.

Figure 5A:
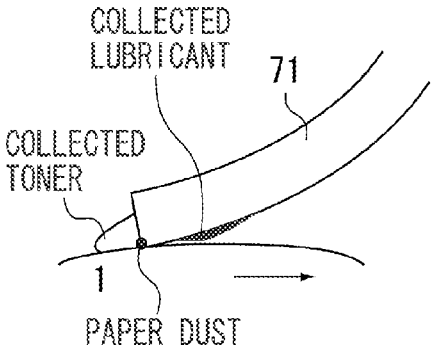
FIGS. 5A, 5B, 5C, and 5D are enlarged views illustrating a cleaning blade nip.
Figure 5B:
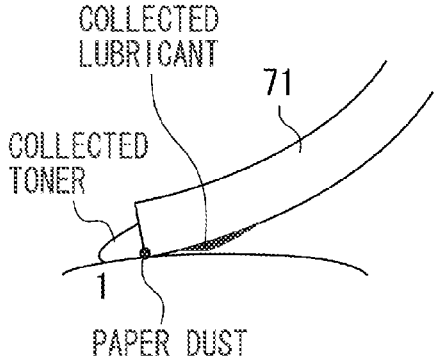
Figure 5C:
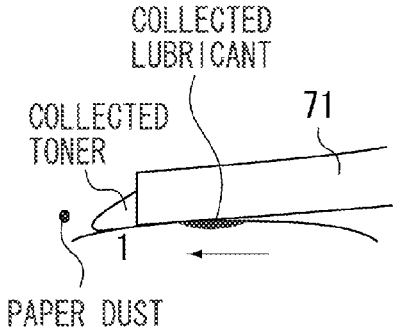

When the drum is stopped in the positive rotation, and the rotation time of the drum is longer than or equal to a predetermined time, the paper dust becomes stuck between the cleaning blade 71 and the drum 1. If the drum is stopped after the inverse rotation, the paper dust can be prevented from becoming stuck. Referring to FIG. 5C, the paper dust which is once stuck is scraped out by the inverse rotation, so that the paper dust can be removed. It is thus necessary to perform the inverse rotation when the rotation time of the drum has become a certain length to prevent the paper dust from becoming stuck. According to the experimental result of the present exemplary embodiment, the inverse rotation becomes necessary when the rotation time reaches 10 minutes.

Figure 5D:
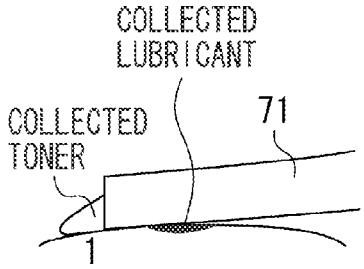

Table 1B indicates levels of the lubricant adhesion. Referring to FIG. 5D, when the lubricant is pressed onto the drum, the lubricant adheres to the drum. If the lubricant firmed adheres to the drum, the lubricant continues to adhere on the drum even when the image is being formed. The drum on which the lubricant adheres is not sufficiently exposed to the laser beam, so that the density of the toner image does not reach the desired level. A horizontal streak may thus appear on the image, which is referred to as a lubricant adhesion mark. Referring to table 1B, "Y" indicates a level within an acceptable limit of the generated adhesion mark, and "N" indicates a level exceeding an acceptable limit of the generated adhesion mark, with respect to a user.

The level of the lubricant adhesion is lower when the rotation time of the drum is longer. Since the amount of the lubricant that becomes separated decreases as the rotation time of the drum becomes longer, the adhering amount decreases, so that the adhesion level is improved. Referring to FIG. 4, the amount of the lubricant which is separated increases as the slope of the graph becomes steeper. A large amount of lubricant thus becomes separated at the initial state of the drum rotation.

Further, the level of the lubricant adhesion increases when the drum is stopped after the inverse rotation. Referring to FIG. 5A, when the image is formed, the lubricant becomes collected by going around to the back of the cleaning blade. When the drum is then stopped after the inverse rotation, the collected lubricant is more strongly pressed onto the drum as compared to when the drum is stopped in the positive rotation as illustrated in FIG. 5B, so that the level of the lubricant adhesion increases. It is thus necessary to perform the positive rotation when the drum rotation time is short to reduce the lubricant adhesion. According to the present exemplary embodiment, the generation of the adhesion mark becomes within the acceptability limit when the rotation time is approximately 10 minutes.

According to the present exemplary embodiment, the paper dust becoming stuck and the lubricant adhesion can both be maintained at a desirable level through the drum life by switching between two states as follows, based on the above-described phenomena. The drum is stopped in the positive rotation in the initial usage state, and the drum is stopped after the inverse rotation in the stages following the initial usage state.

The kinetic friction coefficient μ is measured using HEIDON-14 manufactured by Shinto Kagaku Inc, at normal temperature and normal humidity (25° C./50% RH). More specifically, a predetermined load is applied to the cleaning blade, which is disposed to be in contact with the photosensitive drum. The photosensitive drum is then rotatably driven at 50 rpm, and the friction force applied between the photosensitive drum and the cleaning blade is measured as a distortion amount of a distortion gage attached to the cleaning blade. The distortion amount is then converted to a tensile load. The kinetic friction coefficient can be obtained from [a force applied on the photosensitive drum (g)]/[a load applied on the blade (g)] when the photosensitive drum is rotating. The blade which is used is an urethane blade (rubber rigidity 67°) whose longitudinal width is 230 mm, and measurement is performed in a with direction at an angle of 27° with a load of 100 g. The above-described experiment is different from a usage state of the image forming apparatus. However, a correspondence between the amount of the lubricant and the kinetic friction coefficient can be estimated.

Figure 6:
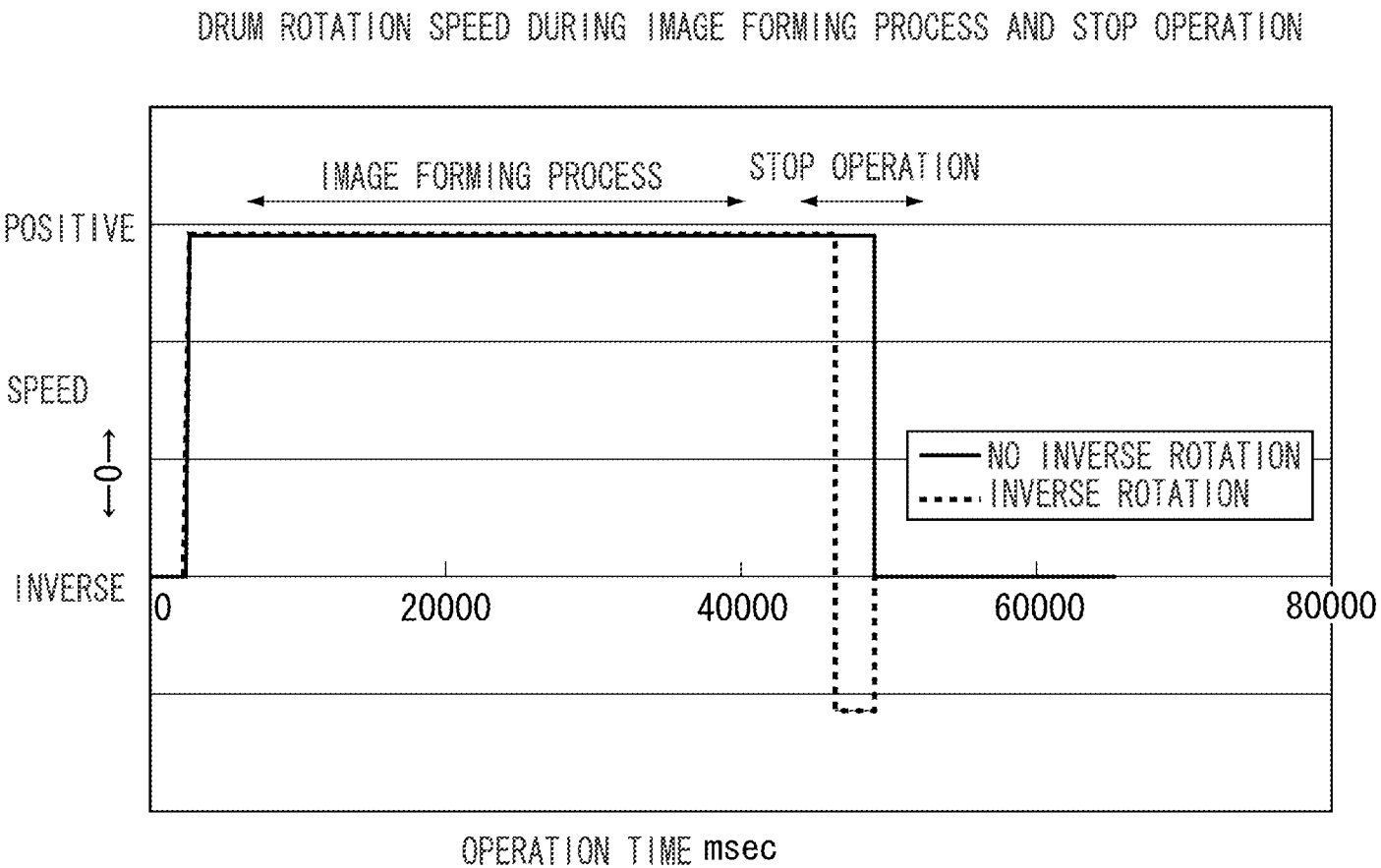
FIG. 6 is a chart illustrating timing of switching the rotational direction according to the first exemplary embodiment of the present invention.

The specification according to the present exemplary embodiment will be described below. FIG. 6 is a timing chart illustrating a number of rotations of the drum in the image forming apparatus according to the present exemplary embodiment. Referring to FIG. 6, when the image forming process ends, the drum stops after a stop operation is performed. According to the present exemplary embodiment, there are two types of stop operation control, i.e., stopping the drum in the positive rotation indicated by a dotted line illustrated in FIG. 6, and stopping the drum after the inverse rotation indicated by a solid line illustrated in FIG. 6. The case where the drum is stopped in the positive rotation corresponds to a first stop operation control described above as a method for solving the problems. On the other hand, the case where the drum is stopped after the inverse rotation corresponds to a second stop operation control described above as a method for solving the problems. According to the present exemplary embodiment, the type of control is selected according to the operation time of the image bearing member.

An inverse rotation time is appropriately determined in a range in which it is effective according to the present invention. If an inverse rotation amount is too small, a removal effect of the stuck paper dust decreases. On the other hand, if the inverse rotation amount is too large, the toner is rubbed onto the belt 61, and different soiling becomes generated. According to the present exemplary embodiment, the image forming apparatus is designed so that the inverse rotation amount is 15 mm in consideration of the above-described phenomena.

Figure 7:
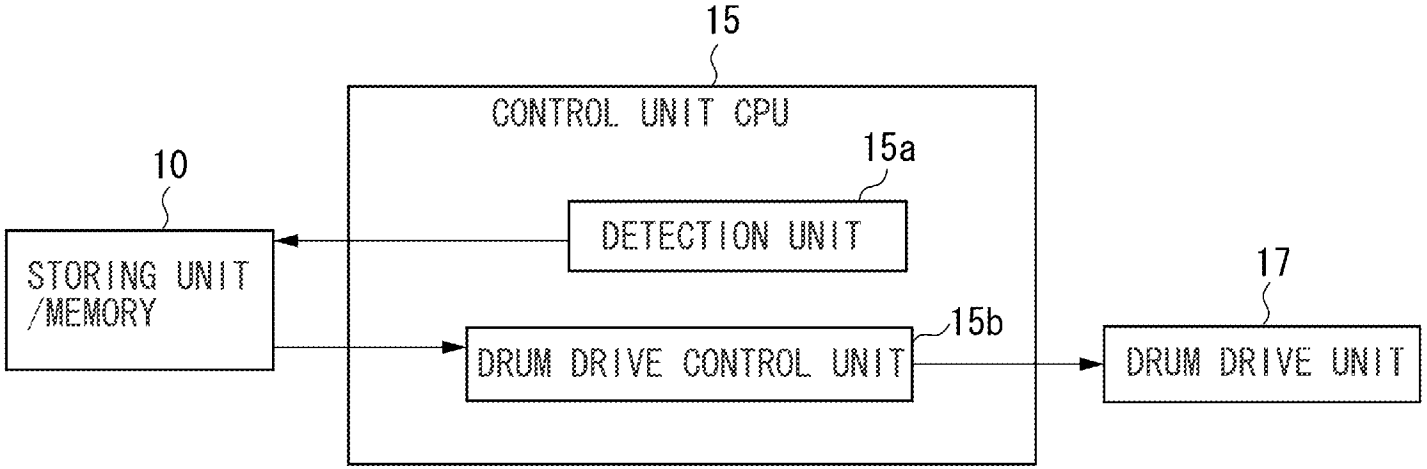
FIG. 7 is a block diagram illustrating a relation between a control unit and other components according to the first exemplary embodiment of the present invention.

FIG. 7 is a block diagram illustrating a control configuration of the image forming apparatus. Referring to FIG. 7, a control unit (i.e., a central processing unit (CPU)) 15 includes a detection unit 15*a* (i.e., a detection unit) and a drum drive control unit 15*b*. A memory 10 stores the rotation time of the drum from when the cartridge is new. A drum drive unit 17 receives an instruction from the drum drive control unit 15*b* and performs control to rotationally drive the drum 1. The detection unit 15*a* detects the rotation time of the drum. More specifically, the detection unit 15*a* calculates and sequentially writes in the memory 10 the drum rotation time. The drum control unit 15*b* changes controlling of the drum driving unit 17 according to whether the stored drum rotation time is shorter than the predetermined time (10 minutes according to the present exemplary embodiment) or longer than the predetermined time.

Figure 1:
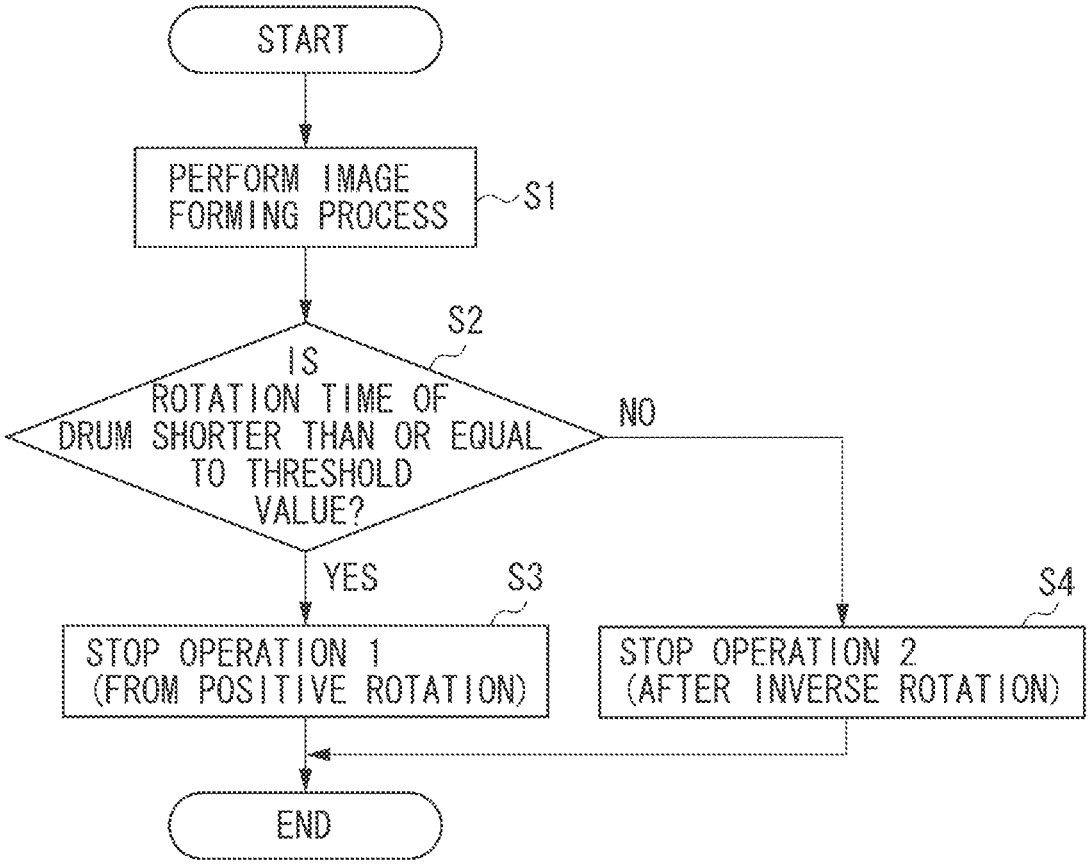
FIG. 1 is a flowchart illustrating a process for selecting a stop operation according to a first exemplary embodiment of the present invention.

The process performed in changing the control of the drum driving unit 17 is illustrated in the flowchart of FIG. 1. In step S1, the control unit 15 performs the image forming process. In step S2, when the image forming process ends, the control unit 15 determines whether the drum rotation time is shorter than or equal to a threshold value. If the drum rotation time is shorter than or equal to the threshold value (YES in step S2), the process proceeds to step S3. In step S3, the control unit 15 stops the drum in positive rotation. On the other hand, if the drum rotation time is longer than or equal to the threshold value (NO in step S2), the process proceeds to step S4. In step S4, the control unit 15 stops the drum after the inverse rotation. The control unit 15 then waits for the next job.

According to the present exemplary embodiment, when the rotation time is within 10 minutes (i.e., a first operation time), the control unit 15 performs the first stop operation control to stop the drum in the positive rotation after the image forming process is ended. Further, when the rotation time exceeds 10 minutes (i.e., a second operation time), the control unit 15 performs the second stop operation control to stop the drum by inversely rotating the drum after stopping the drum following positive rotation without being inversely rotated.

As described above, the control unit 15 selects the stop control based on the first operation time and the second operation time. The second operation time of the drum 1 is longer than the first operation time.

TABLE 2

Switching between not performing and performing inverse rotation based on a threshold value of 10 minutes

| | Drum rotation time | | | | |
|---|---|---|---|---|---|
| | 1 min. | 3 min. | 5 min. | 10 min. | 15 min. |
| Level of paper dust being stuck | Y | Y | Y | Y | Y |
| Level of lubricant adhesion | Y | Y | Y | Y | Y |

"Y" in level of paper dust being stuck: No paper dust is stuck
"Y" in level of lubricant adhesion: Within acceptable limit of adhesion mark generation As a result, a desirable image can be acquired based on the drum life as indicated in Table 2. In other words, in the image forming apparatus employing the blade cleaning method, the image deterioration due to lubricant adhesion and a scratch formed on the image bearing member can be reduced. The image deterioration can be reduced even when the image forming apparatus employs the image bearing member on which low friction processing is performed using the lubricant.

According to the present exemplary embodiment, the stop control method is changed based on the rotation time of the drum. However, the stop control method is not limited to the above. For example, the stop control method may be changed based on the number of rotations of the drum corresponding to the rotation time of 10 minutes. Further, the stop control method may be changed based on a number of sheets on which the image is to be formed as information related to the rotation time of the drum.

Furthermore, according to the present exemplary embodiment, the drum 1, the charging unit 2, the developing unit 5, and the drum cleaning unit 7 are integrated as the cartridge 9 that is detachably attached to the image forming apparatus main body. However, the cartridge is not limited to the above. For example, a drum cartridge in which only the drum is exchangeable may be used. The memory 10 disposed in the drum cartridge may store the rotation time of the drum, and the drum stop control may be selected based on the stored drum rotation time.

Moreover, if the lubricant is applied on the front surface of the cleaning blade, control unit 15 selects the drum stop control according to the operation time of the cleaning blade. It is because the lubricant becomes separated from the cleaning blade along with lengthening of the operation time of the cleaning blade, similarly to when the lubricant is applied on the surface layer of the drum. The operation time of the cleaning blade is the same as the operation time of the drum. In a case where the image forming apparatus employs the cartridge in which the drum 1 and the cleaning unit 7 are integrated as described in the present exemplary embodiment, the rotation time of the drum from the initial use of the cartridge is thus detected as information about the operation time of the cleaning blade. Further, if the image forming apparatus employs a cleaning cartridge in which only the cleaning unit is exchangeable, a memory is disposed in the cleaning cartridge, and the rotation time of the drum form the initial use of the cleaning cartridge is then detected. The detected rotation time can thus be used as the information about cleaning operation time.

Furthermore, the memory may be disposed in the image forming apparatus main body instead of the cartridge, i.e., an exchangeable part. In such a case, an exchange flag is stored in the memory at the timing of exchanging the drum (or the cleaning blade) including the lubricant, and the rotation time of the drum 1 after exchanging is detected.

According to a second exemplary embodiment, a case in which the printing operation is performed in an environmental temperature other than the normal temperature of 23° C. will be described below. Description on the configuration of the image forming apparatus and the printing operation which are in common with those described in the first exemplary embodiment will be omitted.

According to the first exemplary embodiment, the image forming apparatus switches, when printing at 23° C. normal temperature, between the first stopping operation and the second stopping operation based on the threshold value of the rotation time of the drum 1 which is 10 minutes. Referring to FIG. 4, such a threshold value is reached when the kinetic friction coefficient of the drum 1 is 1.0. The inventors have then discovered that the image forming apparatus is capable of performing control with higher accuracy by correcting the threshold value according to the environmental temperature at which the image forming apparatus performs printing.

Figure 8:
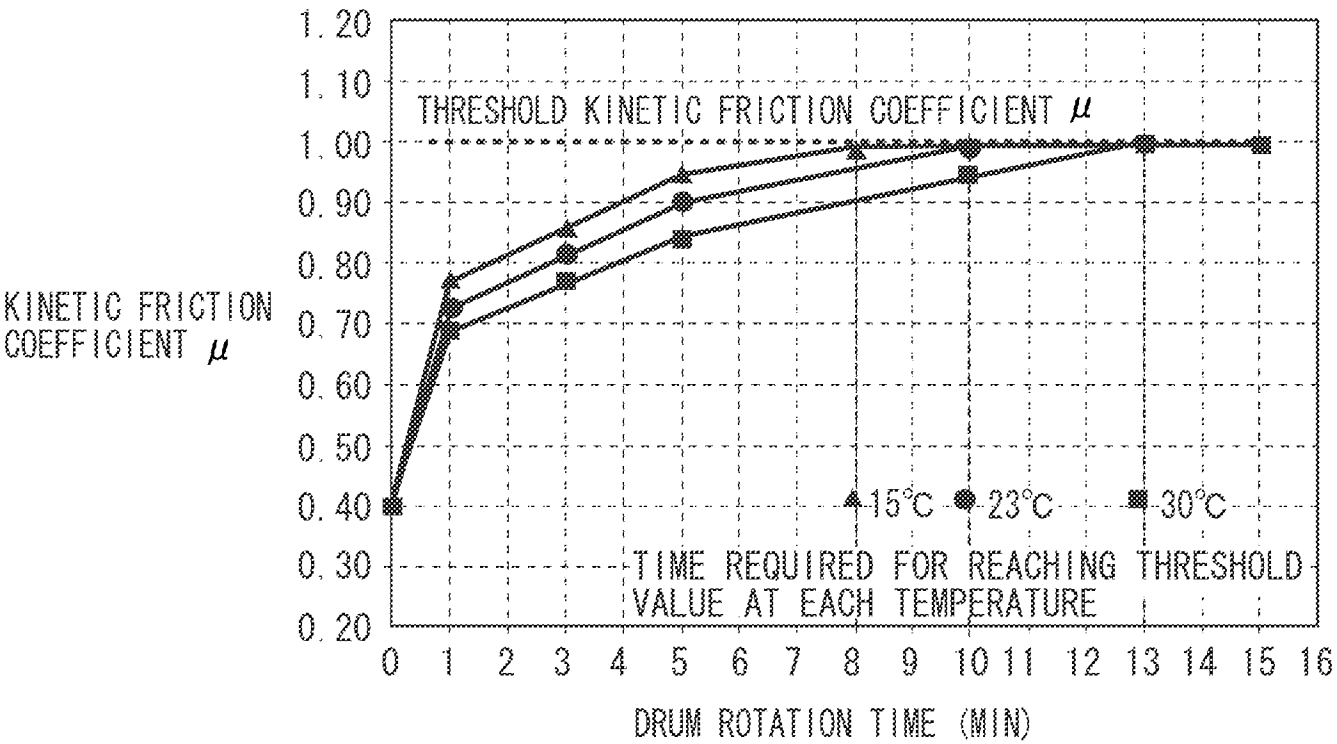
FIG. 8 illustrates a change in the kinetic friction coefficient with respect to the rotation time for each temperature.

FIG. 8 illustrates the result of measuring the change in the kinetic friction coefficient with respect to the rotation time of the drum 1 for each temperature in which the image forming apparatus performs printing. Referring to FIG. 8, the kinetic friction coefficient increases as the drum 1 rotates. A curve of the increase is temperature-dependent, and when the temperature is low, the curve rises steeply, and when the temperature is high, the curve rises gently. Accordingly, the time required for the kinetic friction coefficient to rise to 1.0, i.e., the value to be set as the threshold value, changes with temperature. More specifically, 8 minutes is required at 15° C., 10 minutes at 25° C., and 13 minutes at 30° C. Such a phenomenon occurs at low temperature due to hardening of the member which is in contact with the drum 1 (e.g., the charging roller 2, the developing roller 53, and the cleaning blade 71). When the drum 1 rotates, the above-described member which has become harder is rubbed against the surface of the drum 1, so that the lubricant layer on the drum 1 is more rapidly scraped off. As a result, the problem of the lubricant adhesion is solved in a shorter rotation time. Further, since surface roughness increases along with abrasion, the problem of the paper dust becoming stuck occurs in a shorter rotation time.

Figure 9:
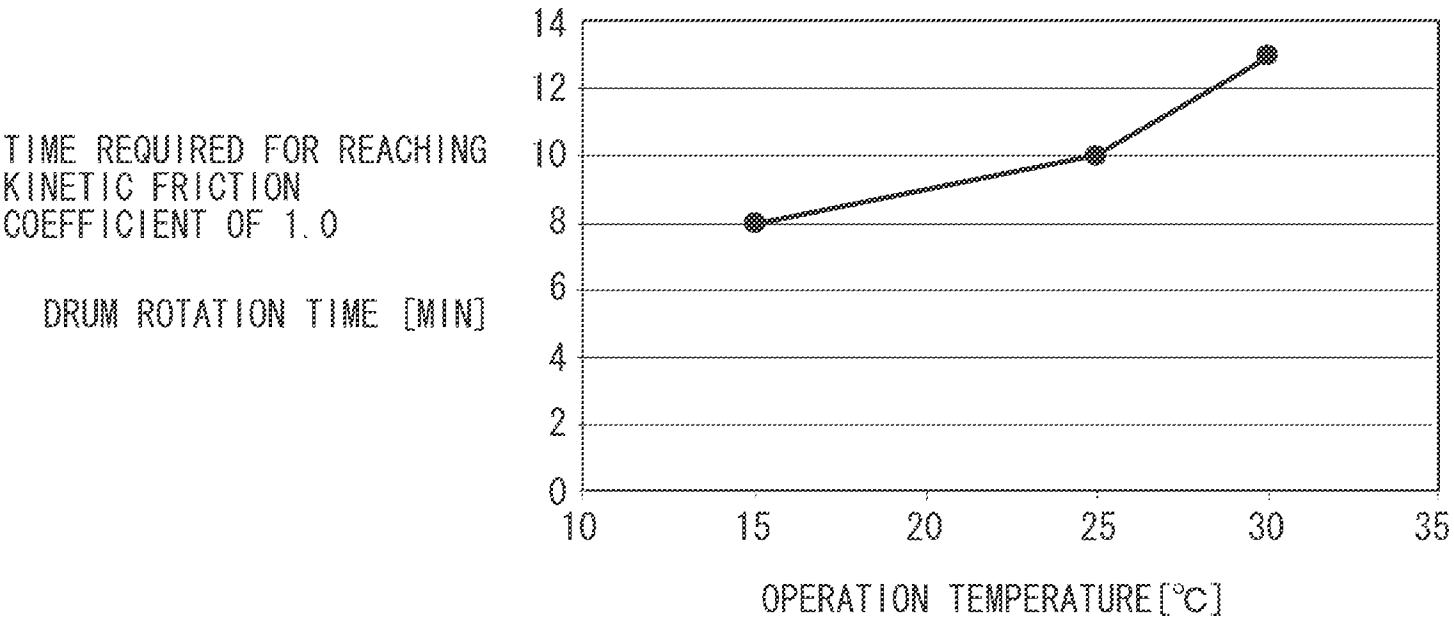
FIG. 9 illustrates the rotation time required for the kinetic friction coefficient to reach a threshold value with respect to temperature.

FIG. 9 is a graph illustrating the rotation time at which the kinetic friction coefficient becomes 1.0 with respect to the environmental temperature in which the image forming apparatus performs printing. Referring to FIG. 9, when the environmental temperature at which the image forming apparatus performs printing is constant, the threshold value can be appropriately set by setting the threshold value on such a line. However, since the image forming apparatus does not usually perform printing at constant temperature, the appropriate threshold value is estimated by weighting the rotation time of the drum 1 (i.e., a shaving speed of the surface of the drum 1) for each environmental temperature. For example, the weights are set as illustrated in table 3. Referring to table 3, the values of the weights are reciprocals of the ratio of the time required for the kinetic friction coefficients illustrated in FIG. 9 to reach the threshold value when the value at 23° C. is 1.

TABLE 3

| | Weight A |
|---|---|
| Below 17° C. | 1.25 |
| 17° C. to below 21° C. | 1.11 |
| 21° C. to below 25° C. | 1.00 |
| 25° C. to below 27° C. | 0.91 |
| 27° C. to below 29° C. | 0.83 |
| 29° C. to below 31° C. | 0.77 |

A weight A for each job is determined based on a value read by a temperature sensor included in the apparatus main body. A correction rotation time is then obtained by integrating the rotation time acquired by multiplying a rotation time t of the drum for 1 job by the weight A. In other words, the correction rotation time is calculated as follows.

$$\text{Correction rotation time}=\Sigma A\times t$$

The correction rotation time is integrated for each job. The correction rotation time is then employed as a comparison parameter with respect to a new threshold value, so that the threshold value can be corrected. The correction of the threshold value will be described in detail below.

Figure 10:
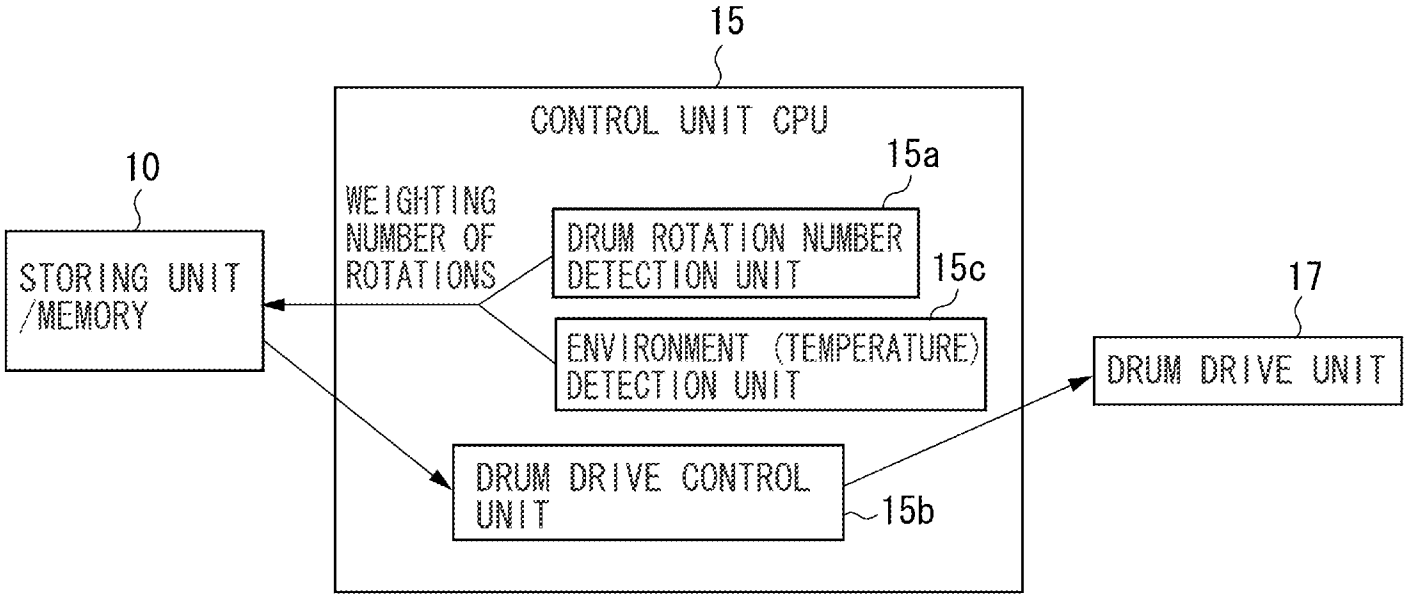
FIG. 10 is a block diagram illustrating a relation between a control unit and other components according to a second exemplary embodiment of the present invention.

FIG. 10 is a block diagram illustrating an image forming apparatus according to the second exemplary embodiment of the present invention. Referring to FIG. 10, an environment detection unit (i.e., a temperature detection unit) 15*c* is added in the control unit (CPU) 15, which is different from the block diagram according to the first exemplary embodiment (illustrated in FIG. 7). The environment (temperature) detection unit 15*c* detects the environmental temperature at which the apparatus main body is placed when printing. Further, an operation for correcting the rotation time of the drum according to the detection result (detected temperature) is added in the control unit 15. Other configuration is similar to that described in the first exemplary embodiment.

Figure 11:
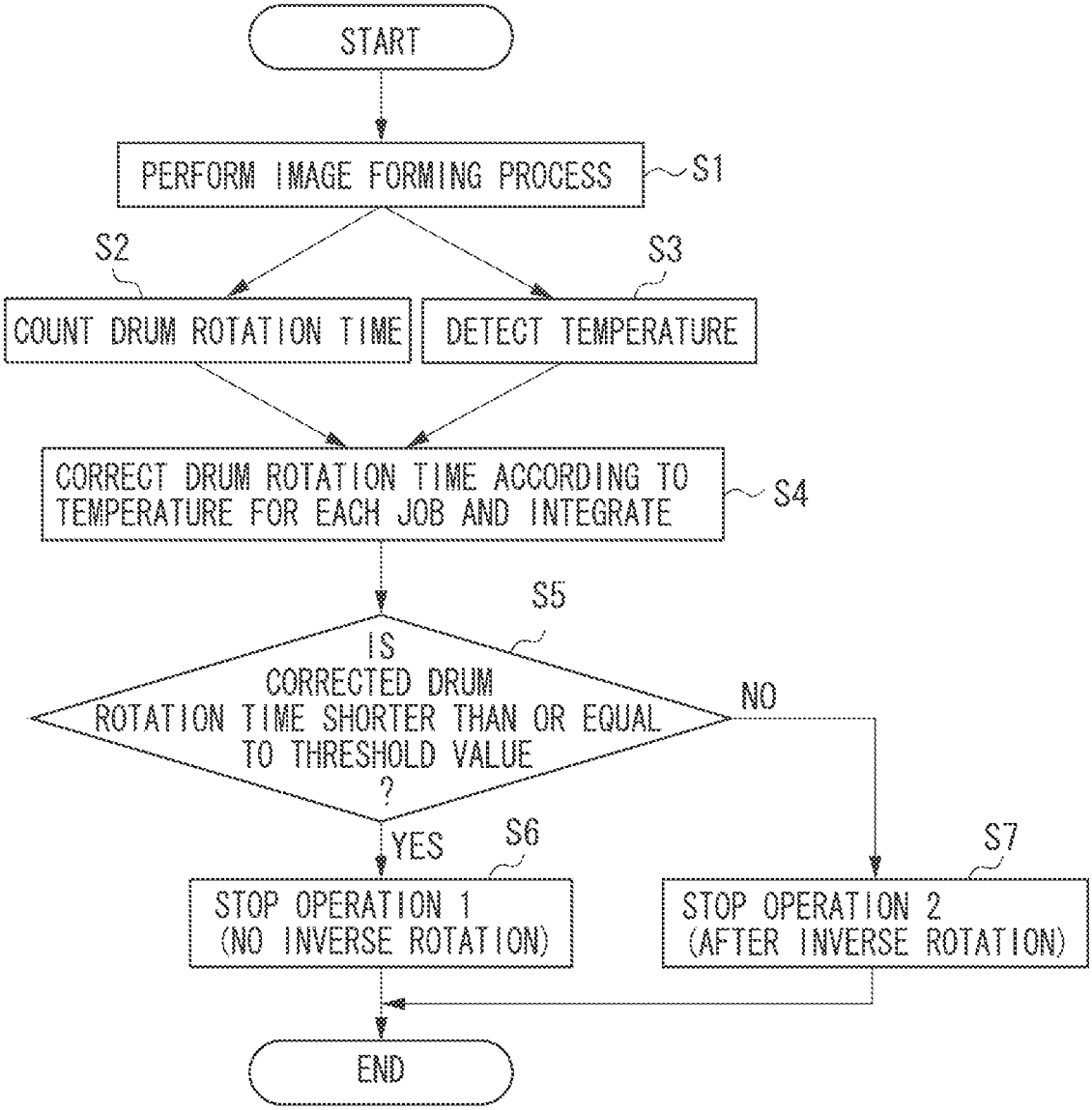
FIG. 11 is a flowchart illustrating a process for selecting a stop operation according to the second exemplary embodiment of the present invention.

FIG. 11 is a flowchart illustrating the process for selecting the stop operation according to the second exemplary embodiment of the present invention. In step S1, the control unit 15 performs the image forming process. In step S2, the control unit 15 counts the rotation time of the drum. In step S3, the control unit 15 detects the temperature. In step S4, the control unit 15 calculates, when the image forming process has ended, a corrected value of the rotation time of the drum according to the temperature, and stores the value in the storing unit (i.e., memory). In step S5, the control unit 15 determines whether the stored value of the rotation time of the drum after correction is less than or equal to the threshold value. The steps to follow are the same as the process described in the first exemplary embodiment.

In general, the rotation time of the drum 1 is weighted by considering whether the charging bias is applied, or whether the drum 1 is in contact with the charging roller 2, the developing roller 53, or the cleaning blade 71, in addition to temperature. Such weights and the weights for each temperature may be employed in combination.

According to the second exemplary embodiment, the rotation time is weighted for each temperature. However, the threshold value may also be changed for each temperature.

TABLE 4

| | Weight B |
|---|---|
| Below 17° C. | −0.2 |
| 17° C. to below 21° C. | −0.1 |
| 21° C. to below 25° C. | 0 |
| 25° C. to below 27° C. | 0.1 |
| 27° C. to below 29° C. | 0.2 |
| Above 29° C. | 0.3 |

In such a case, a weight B is selected from table 4 indicated above for each job, based on a value read by the temperature sensor 68 in the apparatus main body. The weight B is a value set for the control unit 15 to switch between the stop operations at similar timing as indicated in table 3 in each temperature range. The drum rotation time t and the weight B of a job are then multiplied, and the obtained product becomes a correction portion of the threshold value for the job. The obtained value is added or subtracted from a default threshold value, i.e., 600 seconds, and the calculation is repeated for each job. The calculation can be formulated as follows.

$$\text{Corrected threshold value [sec]} = 600\ [\text{sec}] + \Sigma B \times t\ [\text{sec}]$$

Figure 12:
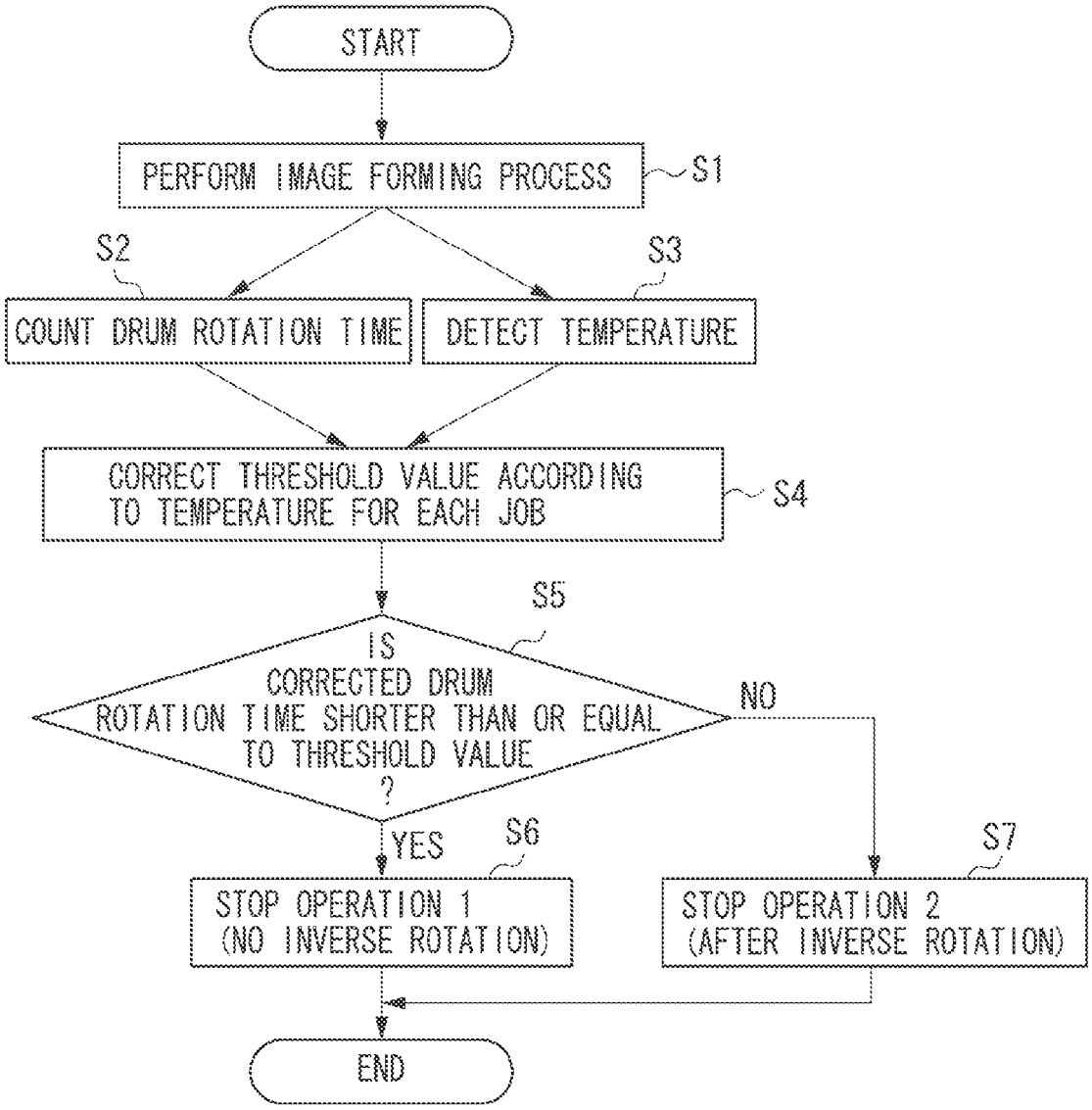
FIG. 12 is a flowchart illustrating a process for selecting a stop operation in accordance with the present invention.

The threshold value can be corrected for each temperature by employing the block diagram illustrated in FIG. 10 similarly to when weighting the rotation time. FIG. 12 is a flowchart illustrating a process for selecting the stop operation. The flowchart of FIG. 12 is different from the flowchart illustrated in FIG. 11 in that the process performed in step 4 can correct the threshold value for each job according to the temperature. As a result of the control unit 15 performing such control, the threshold value can be changed for each temperature.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-288821 filed Dec. 21, 2009 and No. 2010-248982 filed Nov. 5, 2010, which are hereby incorporated by reference herein in their entirety.

What is claimed is:

1. An image forming apparatus comprising:

an image bearing member having a layer including a lubricant on a surface, which carries an electrostatic latent image;

a developing device configured to develop an electrostatic latent image on the image bearing member as a developer image;

a cleaning device that presses a cleaning blade on the image bearing member and removes a developer on the image bearing member when the image bearing member rotates;

a detecting unit configured to detect information about an operation time which is a rotation time of the image bearing member from when the image bearing member has never been used prior; and a control unit, wherein the image bearing member is rotated in a first direction to form an image, wherein the control unit performs, when the image is formed, a first stop operation control in which the image bearing member is stopped without rotating the image bearing member in a second direction which is in an opposite direction of the first direction, and a second stop operation control in which the image bearing member is stopped by rotating in the second direction after being stopped by rotating in the first direction without rotating in the second direction, and wherein the control unit performs, when an operation time of the image bearing member acquired from information about the operation time detected by the detection unit is defined as a first operation time and an operation time of the image bearing member which is longer than the first operation time is defined as a second operation time, the first stop operation control in a case of the first operation time, and the second stop operation control in a case of the second operation time.

2. The image forming apparatus according to claim 1, wherein the information about the operation time is number of rotations or a rotation time of the image bearing member, and the first stop operation is selected when the number of rotations or the rotation time is less than or equal to a threshold value, and the second stop operation is selected when the number of rotations speed or the rotation time is greater than or equal to a threshold value.

3. The image forming apparatus according to claim 1, further comprising an environment detection unit configured to detect a temperature in an image forming apparatus, wherein the information about the operation time of the image bearing member is corrected according to a detection result of the environment detection unit.

4. The image forming apparatus according to claim 1, further comprising an environment detection unit configured to detect temperature in which an image forming apparatus is disposed, wherein a threshold value for selecting a stop operation of the image bearing member is corrected according to a detection result of the environment detection unit.

5. An image forming apparatus comprising:

an image bearing member that carries an electrostatic latent image;

a developing apparatus configured to develop an electrostatic latent image on the image bearing member as a developer image;

a cleaning apparatus that presses a cleaning blade including a lubricant on a surface onto the image bearing member and removes a developer on the image bearing member when the image bearing member rotates;

a detecting unit configured to detect information about an operation time of the cleaning blade from when the cleaning blade has never been used prior; and a control unit, wherein the image bearing member is rotated in a first direction to form an image, wherein the control unit performs, when the image is formed, a first stop operation control in which the image bearing member is stopped without rotating the image bearing member in a second direction which is in an opposite direction of the first direction, and a second stop operation control in which the image bearing member is stopped by rotating in the second direction after being stopped by rotating in the first direction without rotating in the second direction, and wherein the control unit performs, when an operation time of the cleaning blade acquired from information about the operation time detected by the detection unit is defined as a first operation time and an operation time of the cleaning blade is longer than the first operation time is defined as a second operation time, the first stop operation control in a case of the first operation time, and the second stop operation control in a case of the second operation time.

6. The image forming apparatus according to claim 5, wherein the information about the operation time is number of rotations or a rotation time of the image bearing member, and the first stop operation is selected when the number of rotations or the rotation time is less than or equal to a threshold value, and the second stop operation is selected when the number of rotations or the rotation time is greater than or equal to a threshold value.

7. The image forming apparatus according to claim 5, further comprising a temperature detection unit configured to detect a temperature in an image forming apparatus, wherein the information about the operation time of the image bearing member is corrected according to a detection result of the environment detection unit.

8. The image forming apparatus according to claim 5, further comprising an environment detection unit configured to detect temperature in which an image forming apparatus is disposed, wherein a threshold value for selecting a stop operation of the image bearing member is corrected according to a detection result of the environment detection unit.

9. The image forming apparatus according to claim 1, wherein the cleaning blade is disposed in a counter direction with respect to the first direction.

10. The image forming apparatus according to claim 5, wherein the cleaning blade is disposed in a counter direction with respect to the first direction.

* * * * *